United States Patent [19]

King

[11] 4,017,694

[45] Apr. 12, 1977

[54] METHOD FOR MAKING LOUDSPEAKER WITH MAGNETIC FLUID ENVELOPING THE VOICE COIL

[75] Inventor: John A. King, Mentor, Ohio

[73] Assignee: Essex Group, Inc., Fort Wayne, Ind.

[22] Filed: Feb. 18, 1976

[21] Appl. No.: 659,047

[52] U.S. Cl. ..... 179/115.5 VC
[51] Int. Cl.[2] ..... H04R 9/02
[58] Field of Search ..... 179/115.5 R, 115.5 VC, 179/180; 29/594; 335/231

*Primary Examiner*—George G. Stellar

[57] ABSTRACT

A method for the manufacture of loudspeakers having a ferromagnetic fluid contained in the voice coil magnetic air gap and being confined by the loudspeaker magnet field thereby enveloping the portions of the voice coil that are within the magnetic air gap. A critical viscosity range of the ferromagnetic fluid is required, the viscosity determined by the viscosity of the liquid phase and the concentration of the colloidal ferromagnetic particles which provide the viscous damping forces on the voice coil effective at low and high frequencies. The damping forces are due to shearing stress set up in the fluid by motion of the voice coil in response to electrical excitation and result in surprisingly improved acoustical performance, higher electrical output and freedom from hiss in the loudspeaker. The ferromagnetic fluid also provides an improved heat sink for the voice coil thus improving the electrical power dissipation capability of the voice coil. An opening in the cap over the voice coil permits entrapped air under the cap or dust cover to escape thereby eliminating a noticeable hiss.

10 Claims, 12 Drawing Figures

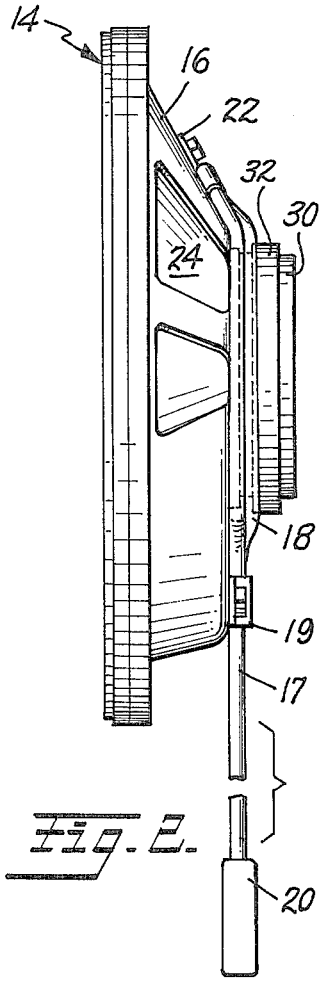
Fig. 2.
Fig. 1.
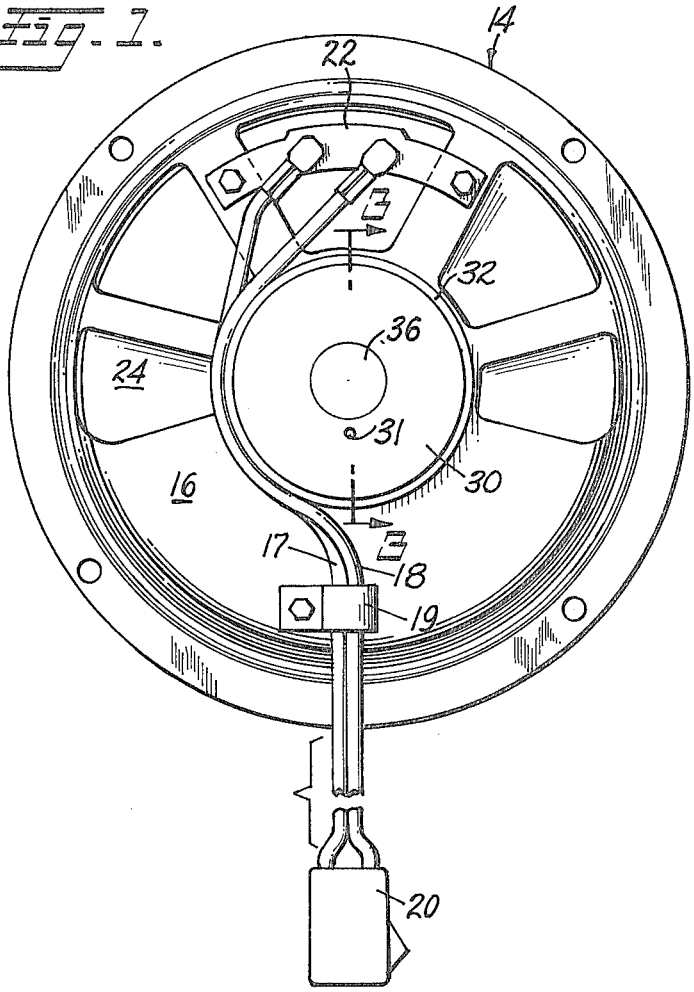
Fig. 12.
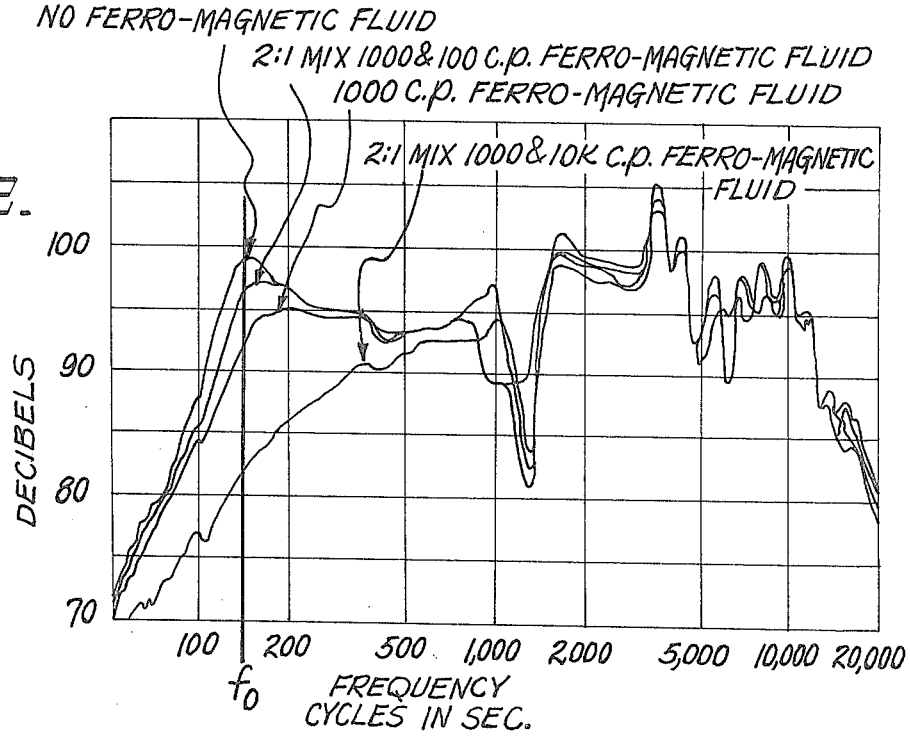

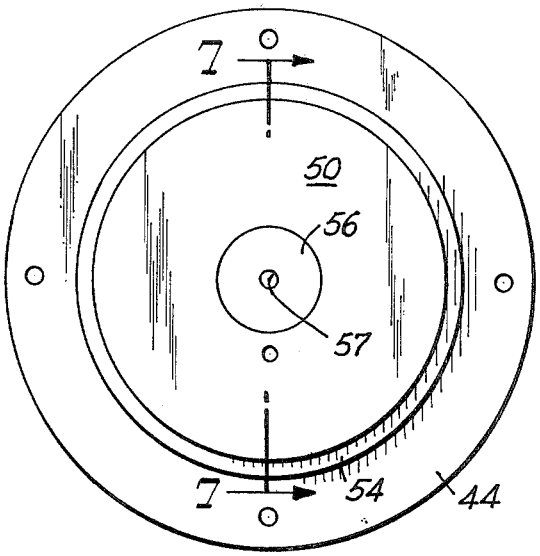
Fig. 8.
Fig. 7.
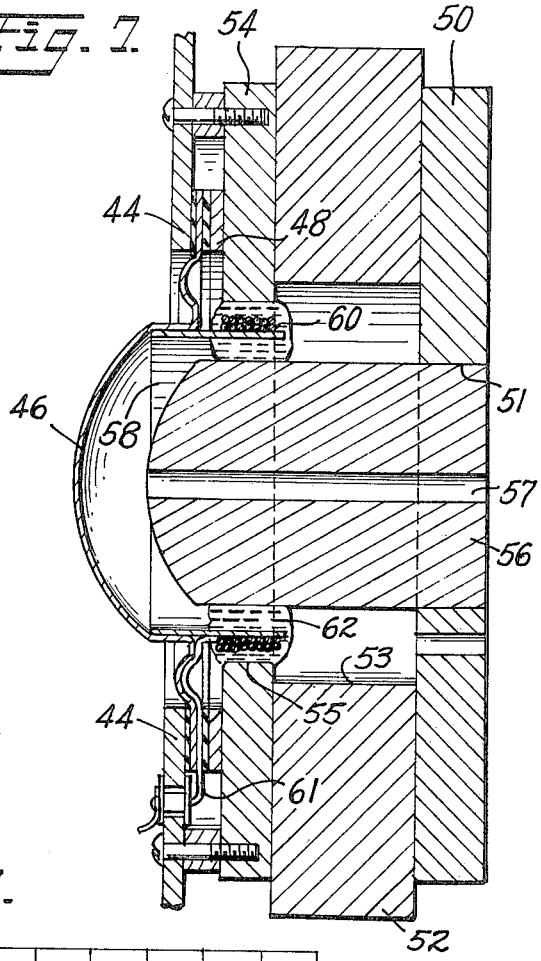
Fig. 11.
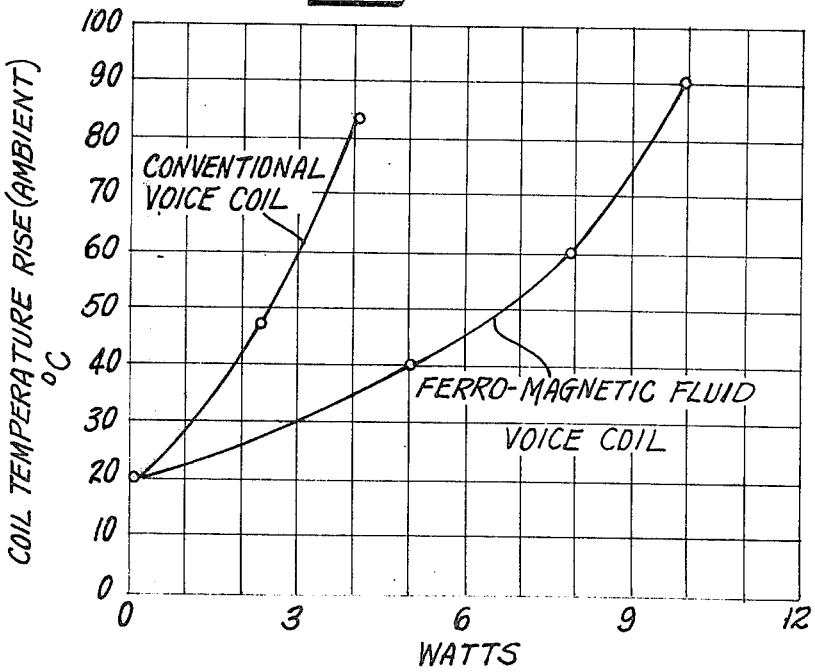

METHOD FOR MAKING LOUDSPEAKER WITH MAGNETIC FLUID ENVELOPING THE VOICE COIL

BACKGROUND OF THE INVENTION

A. Field of the Invention

This invention lies in the field of improving the damping action for loudspeakers and acoustic membranes which respond to electrically actuated voice coils movable to reproduce the entire frequency range and the desired intensity of acoustic vibrations and in particular relates to improvements in both the response of the diaphragm to the voice coil throughout the entire frequency range and to the heat dissipation from the voice coil.

In connection with this improvement in acoustic response and in heat dissipation, the invention also relates to novel means which prevent dust contamination effecting the voice coil and thereby impairing the operation of the voice coil when damping means in the form of a ferromagnetic fluid is applied to the voice coil.

B. Description of the Prior Art

1. The Use of Liquids in the Transducer

Fluids have been used heretofore to exhibit transducing action at a meniscus in response to changes in an electrical field and an example of such fluid is mercury used to convert electrical potential directly into liquid pressure as shown in Burgess, U.S. Pat. No. 2,416,978 of Mar. 4, 1947. However, this Burgess device does not provide a damping function nor is there a heat sink.

2. Use of Liquid Suspensions Containing Finely Divided Solids

Haines et al, U.S. Pat. No. 3,304,378, shows an electrical field effect transducer in which a suspension of silica in oil is used as a shear-responsive fluid confined between opposed conducting surfaces and which serves as a frequency doubling sonic transducer.

Klass, U.S. Pat. No. 3,385,793, discloses electroviscous fluids which respond to the influence of electric potential by evidencing an apparent pronounced increase in bulk viscosity. A number of such fluids are also described in U.S. Pat. Nos. to Willis M. Winslow, 2,661,596; 2,661,825 and 3,047,507 and are useful in clutches, wherein the fluids are disposed between the surfaces of two electrically conductive members, and an electric potential is imposed across the two members. The fluid responds to the application of electric potential by instantaneously but reversibly changing in bulk viscosity.

Flame-resistant hydraulic fluids have been disclosed in U.S. Pat. No. 3,567,644 to Hotten and these fluids are used with thickeners or suspending agents to be operable for power transmission in a wide range of temperatures. These fluids are compared with phosphate materials which have low viscosity indices to require substantial amount of viscosity index improvers and have also been compared with chlorinated waxes which require chlorination of at least 40° to achieve flame-resistance. However, these chlorine containing materials are dangerous because they give a lot of fumes.

Special phosphates have been described in Attwood, 3,074,889 which are modified with flame-proofing agents.

Yamamuro et al, U.S. Pat. No. 3,828,144, shows a vibration absorbing support for loudspeaker voice coil bobbin in which the vibration absorbing members are formed of silicone rubber. Williams et al, U.S. Pat. No. 2,444,620 and Barker, U.S. Pat. No. 2,164,374 each teach elastic resilient suspensions for the diaphram.

3. The Commercial Development and Use of Magnetic Fluids

In Machine Design, June 1, 1972, there appears an article entitled "Magnetic Fluids" by Francis J. Lavore, which describes a colloidal suspension of ferrite particles about 100 Angstroms in size suspended in a nonvolatile liquid such as a hydrocarbon, a silicone or a fluorocarbon which is used as a seal. The material for this seal is identified under the Trademark "FERROMETIC", manufactured by the Ferrofluidics Corporation, 144 Middlesex Turnpike, Burlington, Massachusetts 01803 and the "Newsreports" section in Electrimechanical Design, October 1973 describes the use of Ferrofluids to seal the space between the poles of a loudspeaker.

The magnetic fluid seals which are described in U.S. patents by the Ferrofluidics Corporation are the following:

| Name | Pat. No. | Title |
|---|---|---|
| Rosensweig | 3,612,630 | Bearing Arrangement With Magnetic Fluid Defining Bearing Pads |
| Rosensweig | 3,620,584 | Magnetic Fluid Seals |
| Rosensweig et al | 3,648,269 | Magnetic Fluid Display Device |
| Rosensweig | 3,734,578 | Magnetic Fluid Pneumatic Bearings |

SUMMARY OF THE INVENTION

This invention relates to the use of a magnetic fluid, hence to be referred to as a ferromagnetic fluid, confined to the voice coil air gap cavity by the loudspeakers magnetic flux field, and enveloping portions of the voice coil of dynamic loudspeakers. And the means to prevent hissing by providing an opening in the dust cover over the voice coil for air to escape. A critical viscosity range of the ferromagnetic fluid is required.

DISTINCTIONS OF THE INVENTION OVER THE PRIOR ART

A. Criticality of Viscosity

The present invention is based upon the unexpected discovery that in the low frequency performance range of the loudspeaker there is achieved an elimination of the air gap under-damping of the loudspeaker independent of the power input to thereby improve the bas response if, and only if, the ferromagnetic fluid has a viscosity between about 1000 centipoises and 10,000 centipoises. These viscosities are substantially different from those used in other ferrofluid uses. The frequency characteristic curve which measures the decibel output at various frequency values of the loudspeaker after the introduction of the ferrofluids in the air gap of the annular voice coil not only permits the improved base frequency response to be achieved over a large range of power inputs but also over a very wide temperature range to thereby upgrade performance ratings below the maximum or optimum ratings of the loudspeaker, and well beyond, more than 200%–300% of such ratings without introducing gross distortion. In this manner, performance is freed from the requirement of heavy magnets.

B. Requirement for Air Venting

The introduction of any fluid material into the air cavity of the loudspeaker requires protection of the voice coil by a dust cap and it has been found essential that the dust cap be vented. The loudspeaker units with ferrofluid in the air gap require venting of the air cavity behind the dust cap and the air cavity behind the voice coil as well to avoid and eliminate spurious noise generation, eg., hissing, and possible displacement of the fluid due to splattering at high power levels.

C. Detailed Comparison With Prior Art

In contrast to Haines et al, U.S. Pat. No. 3,304,376, in which the electrical field effect is used to double the frequency, the present ferromagnetic fluid in the air gap around the voice coil merely smooths the frequency response curve and eliminates the dips in frequency so that there is achieved the advantage of heavy magnet with massive baffles in a relatively small speaker.

The distinction of Haines et al is also true for Klass, U.S. Pat. No. 3,385,793, and for the Winslow patents.

An unexpected benefit is had with the particular speaker liquid phase selection of the invention because of the absence of toxic materials such as the phosphates in Attwood, U.S. Pat. No. 3,074,889, or of the chlorinated hydrocarbons such as Hotten, U.S. Pat. No. 3,567,644.

Surprisingly, the low frequency response using the particular speaker of the present invention is achieved without any of the requirements for silicone rubber mounting as in Yamamuro, U.S. Pat. No. 3,828,144 to thereby establish that the present system achieves its results by a totally different and novel principle and in which pumping and hissing sounds are eliminated as extraneous noises.

OBJECTS OF THE INVENTION

An object of the invention is to overcome the deficiencies in low frequency response of small diameter speakers having relatively small or low mass permanent magnets by introducing into the air gap around the voice coil a ferromagnetic fluid of critical viscosity whereby both low and high frequency responses are achieved which are far superior than to the response for the same signal to the voice coil in the absence of the ferromagnetic fluid.

Further object of the invention is to provide a method for mixing ferromagnetic fluids to adjust viscosity to a critical and optimum value for improving the low and high frequency response of a loud speaker.

Still a further object of the invention is to vent the column of air trapped behind the voice coil so that there is no acoustic interferance by way of the creation of hissing sounds as a result of an improvement of the voice coil and diaphram of the speaker.

A still further object of the invention is to provide a vent which may be fabricated from an air permeable material and thereby assure a vent area in the dust cap greater than 10% of the total dust cap area and for porous materials, an air permeability greater than about 50 CFM per square foot at an air pressure of 0.5 inches.

Another object of this invention is to introduce a ferromagnetic fluid for low and high temperature performance and selected viscosity depending on the particular loudspeaker requirements in respect to the Q value, into the voice coil air gap cavity and enveloping the portions of the voice coil within the air gap of the loudspeakers magnetic field to enhance the acoustical performance and improving the electrical power dissipation capability of the unit.

BRIEF DESCRIPTION OF THE DRAWING

FIG. 1 is a rear elevational view of a loudspeaker according to the present invention;

FIG. 2 is a side elevational view of the loudspeaker of FIG. 1;

FIG. 6 is a rear elevational view of a modification of the loudspeaker;

FIG. 7 is an enlarged fragmentary vertical sectional view, taken on the line 7—7 of FIG. 6;

FIG. 11 is a graph comparing the temperature rise and the ferrofluid voice coil of the present invention; and FIG. 12 is a graph showing the results obtained from the various mixes of ferrofluid for the voice coil and a voice coil having no ferrofluid mix.

DESCRIPTION OF THE PREFERRED EMBODIMENTS

Figure 10:
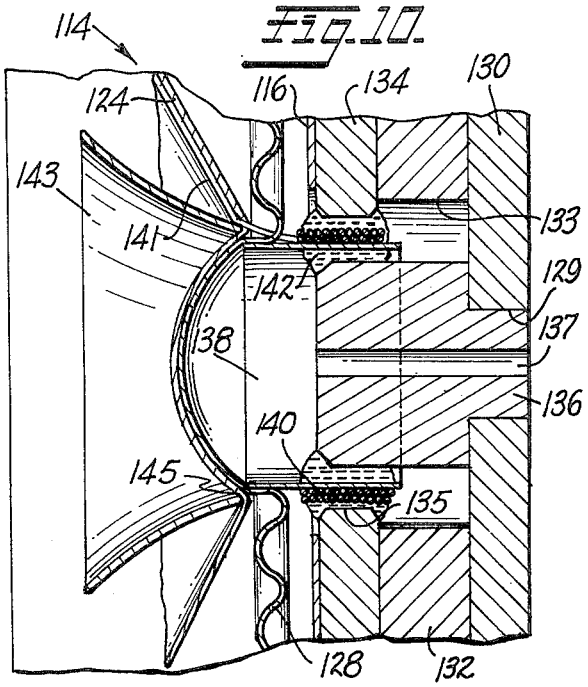
FIG. 10 is an enlarged fragmentary vertical sectional view, of a modified form, showing a dual cone speaker.

1. Requirement for Venting in the Invention

Motion of the moving coil system results in pumping of air by the dust cap through the ferrofluid around the voice coil with attendant noise of the cavity behind the dust cap is not vented. The annular area of the rear of the voice coil pumps air in and out of the cavity in the magnetic structure through the ferrofluid with resultant noise which is unacceptable with unvented full range type loudspeakers.

2. Ease of Formulation at Predetermined Viscosity

In the utilization of commecial available ferrofluids, it has been found that hydrocarbon liquids, silicone liquids, fluorocarbon liquids and polyester liquids are available in very fluid mixtures and in very viscous mixtures. Blending within the same liquid class, eg., blending polyester at 1 centipoise with polyester at 100,000 centipoises is all that is necessary to achieve a mixture at 1000 centipoises or at 10,000 centipoises or at a value which lies at any preselected value between these.

3. Damping Forces

The presence of ferromagnetic fluid of a selected viscosity of ferromagnetic fluid confined in the voice coil magnetic air gap and enveloping the portion of the voice coil magnetic air gap and enveloping the portion of the voice coil within the air gap results in a damping force on the voice coil due to motion of the voice coil in response to electrical excitation of the voice coil in the loudspeaker. This damping force is the reaction force of the voice coil resulting from the shear stress developed in the ferromagnetic fluid in response to motion in the voice coil.

The presence of a ferromagnetic fluid of a selected viscosity of ferromagnetic fluid confined in the voice coil magnetic air gap and enveloping the portion of the voice coil within the air gap results in a damping force on the voice coil due to motion of the voice coil in response in electrical excitation of the voice coil in the loudspeaker. This damping force is the reaction force of the voice coil resulting from the shear stress developed in the ferromagnetic fluid in response to motion in the voice coil.

In an ideal configuration where the ferromagnetic fluid is contained between two closely spaced parallel plates with one plate movable, and with the plates large enough to minimize edge effects, the damping force, F, will be directly proportional to the area of the plate, A. The velocity, U, of a movable plate and the viscosity, $\mu$, of the fluid are inversely proportional to the spacing, $\mu$, between the plates as in Equation 1.

$$F = \mu \frac{AU}{t}$$

In a loudpspeaker this ideal configuration is only approximated. Also typically both the inside and the outside areas of the coil are acted on by the ferromagnetic fluid, although in certain configurations having voice coils at least two times as long as the air gap height, the ferromagnetic fluid is confined to either the outer diameter, O.D. or inner diameter, I.D. of the voice coil only.

This proportionality of the damping force to velocity is called viscous damping and is of particular importance in modifying the acoustical response of a loudspeaker at frequencies in the vicinity of the principal resonance frequency.

Q FUNCTION AND FREQUENCY RESPONSE

It is in this low frequency region of the amplitude versus frequency response, that insufficient damping may be present resulting in deleterious effects in the acoustic performance. It is also at frequencies in this region that the moving system velocity becomes greatest, therefore the introduction of viscous damping can reduce the amplitude of motion of the moving system in this region without significantly affecting the acoustic output over the remainder of the useful frequency range of the loudspeaker.

In the present invention ferromagnetic fluids of a diester base have been found particularly useful in this application due to their stability and availability in a wide range of viscosities. Viscosities on the order of 500 – 6000 centipoises, preferably 1000 centipoises have been found to be effective in increasing the damping force on the moving system.

Quantitavely, the acoustic output of direct radiator dynamic loudspeaker at frequencies in the vicinity of the principal resonance frequency is a function of the Q of the loudspeaker (acoustic power output is proportional to $Q^2$). Q is defined as the ratio of energy stored in a system to the energy dissipated at the resonance frequency per cycle of excitation. This ratio is expressed in Equation 2.

$$Q = \frac{wm}{R}$$

In Equation 2 $w - 2 f_o$ where $f_o$ is the principal resonance frequency, determined by the values of total mass and stiffness elements of the loudspeaker moving system (cone, voice coil, cone suspensions, the acoustic load); $wm$ is the reactance of either the mass or stiffness element at $f_o$. R is the total damping (resistance) elements in the system. Thus an increase in the value of the parameter R accomplished by introducing viscous damping will decrease the value of Q. Values of Q greater than unity result in undesirable enhanced acoustic output and impared transient response at frequencies in the vicinity of $f^o$.

Inexpensive loudspeakers often exhibit too high a value of Q for optimum performance. Lowering the Q by increasing electrodynamic damping in general requires increased magnet volume so therefore is a relatively expensive approach. The use of a ferromagnetic fluid to lower Q is much less expensive. It also has another beneficial property of increasing the loudspeaker electrical power dissipation capability due to the improved heat sink that the intimate contact of the ferromagnetic fluid provides with the voice coil and air gap pole faces. See FIGS. 1, 2, and 12.

A reduction in the average voice coil temperature from 103° C to 60° C occured with the addition of ferromagnetic fluid to the loudspeaker so that the electrical power rating could be increased by over 100% for the same coil temperature. Reduced values of Q also result in improved transient response (reduced ringing) for the loudspeaker.

Loudspeakers having a magnetic structure which presents, in conjunction with the ferromagnetic fluid in the voice coil air gap cavity, a sealed cavity behind and contigous with the voice coil air gap cavity may require venting to the atmosphere in order to reduce the generation of spurios noise at excitation levels above a critical level, which is a function of the particular loudspaker due to the pumping of air into and out of the sealed cavity through the ferromagnetic fluid in the voice coil air gap. The annular cross sectional area of the rear end of the voice coil acts as a piston to pump the air. The spurious voice generated by this action is generally objectionable only in a full range type loudspeaker which has a principal resonance frequency below 300 hz so that voice coil velocities become high enough to create internal pressures great enough to force air through the ferromagnetic fluid at normal excitation levels.

PERFORMANCE CHARACTERISTICS OF FERROFLUIDS AUTOMOTIVE SPEAKERS, CLOSED CONE SPEAKERS AND DOUBLE HORN SPEAKERS

The watt output performance of this type is shown in FIG. 11 and provides a reduction in the average voice coil temperature from 103° to 60° C occurred with the addition of ferromagnetic fluid to the loudspeaker so that the electrical power rating may be increased by over 100% for the same coil temperature. Reduced values of Q also result in improved transient response (reduced ringing) for the loudspeaker.

Figure 5:
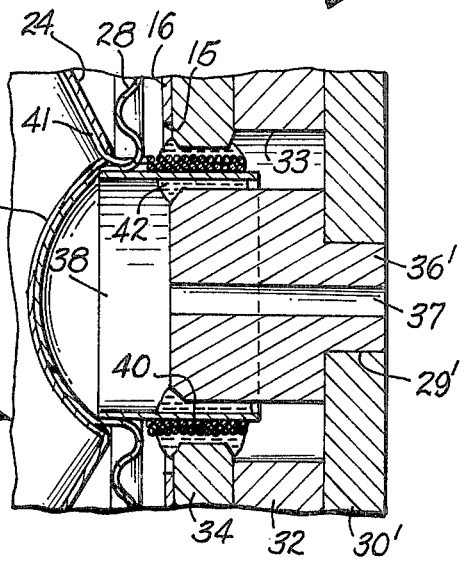
FIG. 5 is a fragmentary vertical sectional view, similar to FIG. 3 showing a modified form of air vent for the voice coil.

An air vent is provided as shown for each of the FIGS. 1, 5 and 11 into which dust may enter and an air permeable material in the form of fabric may serve to cover the vent and prevent the entry of dust and even as clogged, will be cleaned by the pumping action of the air as the air pressure is generated during pumping action.

The loudspeaker which is illustrated in FIGS. 1 and 2 is one which is adapted for use in an automobile and is subject to the performance requirements by the automobile manufacturer. The radio or tape deck in the car must provide the desired performance at extremes of temperature, e.g., −20° F+120° F as encountered during climate extremes in different location (desert, arctic regions, tropics, etc.).

Figure 8:
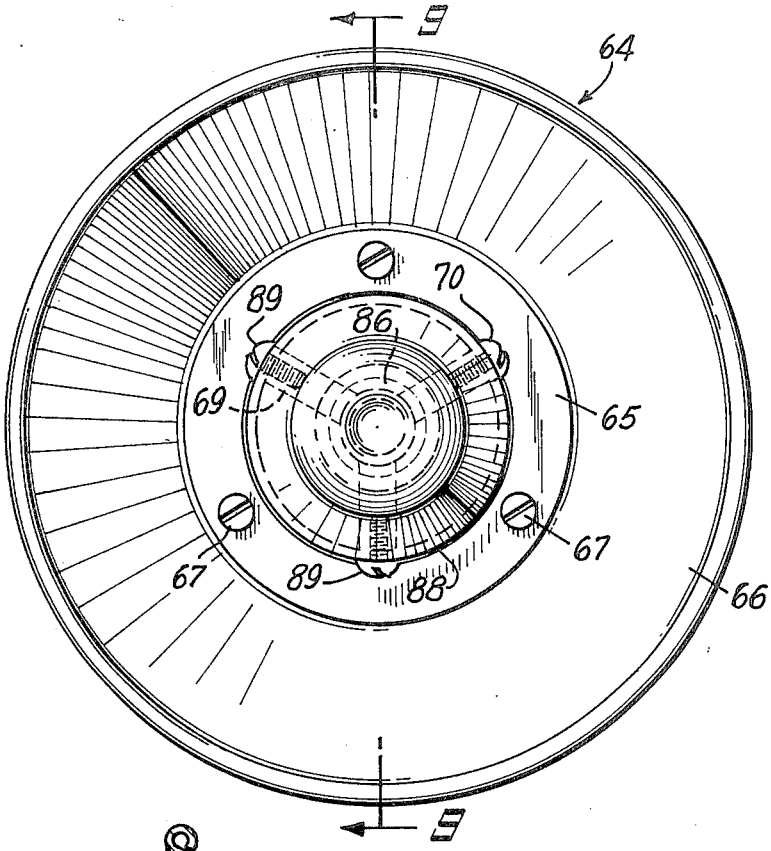
FIG. 8 is a front elevational view of a reentrant dynamic horn loudspeaker embodying the voice coil arrangement of the present invention.

Referring now to FIGS. 1, 5, 8 and 10, the improvement in performance characteristics are surprisingly found to be the same order of magnitude for each of the different speaker type despite the differences in operation, e.g., the automotive speaker of FIG. 1, the midrange or tweeter speaker of FIG. 5 characterized by operation over a restricted range of frequencies generally 400–5,000 Hertz for a midrange unit and 2,000–20,000 Hertz for a tweeter unit and having an optimal tight dust cap over the core, the double cone speaker of FIG. 10 and the dynamic horn speaker of FIG. 8, and these performance characteristics are summarized in FIGS. 11 and 12 of the drawings. The basic speaker structure of automotive type of speaker is that shown in FIGS. 1 and 5.

The performance graphs which are summarized in FIGS. 11 and 12, although made with the automotive speaker of FIG. 1, are representative of tests conducted on all of the speaker embodiments illustrated herein and the same enhancement is shown to thereby establish the general applicability of the ferrofluid development at critical viscosity range within the composition parameters.

Reference is now made specifically to FIG. 11 which shows the coil temperature in each of the speaker for the conventional voice coil without the ferromagnetic fluid and for the voice coil with the ferromagnetic fluid in the air gap plotted against Watts input to the coil for the simpliest low cost 5 inch speaker of FIG. 1. The generalized date referred to here and above is reflected, e.g., a reduction in the average voice coil temperature from 103° C to 60° C occurred with the addition of ferromagnetic fluid to the loudspeaker so that the electrical power rating could be increased by over 100% for the same coil temperature. Reduced values of Q also result in improved transient response (reduced ringing) for the loudspeaker.

The data in FIG. 12 were obtained with the standard Brule and Kjor Copenhagen Acoustic Testing Machine which measures the decibels output against frequency. The control speaker performance measured the air gap containing no ferromagnetic fluid and compared this with the speaker of FIG. 1.

Thus the invention permits one to balance acoustic heat transfer and hysterisis effects which can be defined as mechanical energy of the speakers converted into heat energy absorbed by the fluid rather than retained by the voice coil in the air environment.

Since non-Newtonian fluids will absorb more heat and since the heat radiation contributed by the metal powder will enhance heat loss, these two factors can be separately controlled while at the same time effecting mechanical damping to smooth out or remove distortion peaks in the cone.

It appears that increasing viscosity and dropping the metal content for the tweeter will result in entirely different specifications for the tweeter than for the woofer.

FIG. 12 shows cancellation of the mid-range resonance frequency of a tweeter, which may be at values of 50H to 2,000H could require a more viscous liquid, and a lower metal content than the suppression of cancellation of the resonance frequency of a woofer or of a full range speaker.

It appears from my study of the I.R. analysis, the 10,000 cps diester fluid, that the liquid is an aliphatic diester such as sebacate and not an aromatic diester (dibutyl phthalate), and that the specification for low temperature performance used by the automobile manufacturers, e.g., American Motors, General Motors and Ford is met by these fluids having higher and low viscosities before the metal particles are added in making the fluid ferromagnetic.

The ferrofluid liquid for a home indoor speaker need not meet the −20° F specification of Ford or the −40° F specification of American Motors, yet it often will meet more difficult requirements at high temperatures because continued performance at 100–300% overhead for long time periods.

It has been found by extensive experiment that the iron metal content or magnetic oxide content may be any metal which is magnetic or those mentioned in the Rosensweig patents acknowledged in the prior art and that the metal or oxide contained may vary from fluidity or causing leaking. The metal need not be magnetized and cost savings will result from omitting the magnetizing step.

CRITICALITY OF LIQUID SELECTION OF FERROFLUID

The liquid selection for the ferrofluid is one which meets the requirements of the environment in which the speaker is placed and must also meet the requirements to permit handling by a skilled pesonnel. Poisonous or toxic materials which represent a hazard to animal life or to man must be avoided. For this reason, chlorinated hydrocarbons and phosphates which are damaging to living cells are to be avoided. Only after comparable experimentation, the suitable fluid had been determined to be the polyester of the aliphatic type, the silicone liquids, the fluorocarbons and the hydrocarbons, all of these being non volatile and not being easily added to this, a commercially available suspension as required.

The ferrofluid is a colloidal suspension of irregular shaped magnetic particles on the order of magnitude of 100 angstroms (microinches) in size in the liquid carrier, which in the present invention must be non volatile, non-toxic and usable over a wide temperature range and of critical viscosity. Brownian motion prevents any tendency toward settling of the particles. The particles may be coated with an antistick agent in very small amounts to insure against coalesing. There are only about $10^{17}$ particles per CC so that the unmagnetized fluid behaves essentially like the carrier.

The preferred aliphatic diesters are particularly useful because of low vapor pressure (1 TORR at 150° C) to insure long life, a wide operating range of temperature (−35° C to 150° C), chemical inertness, and availability in a wide range of viscosities (100 – 10,000 Centipoise).

The ferrofluid is magnetically saturated in a typical loudspeaker voice coil air gap. An MMF of 5000 oust-eds produces a saturation induction of 100 – 200 gauss. This induction is not great enough to increase the air gap flux density significantly. The magnetically saturated ferrofluid also exhibits an increase in viscosity.

In a typical loudspeaker air gap, it is nearly impossible to dislodge the fluid, ie, dropping the loudspeaker will not result in a loss of ferrofluid from the air gap.

The ferrofluid is normally placed into the voice coil air gap cavity by magnetizing the unit prior to the assembly of the voice coil and injecting the desired quantity with a calibrated syringe. A normal quantity forms a convex meniscus on the top of the air gap annulus. The voice coil assembly can then be installed by inserting it through the ferrofluid using a temporary alignment shim (if required for centering). The fluid will be temporarily displaced by the shim, but upon removal of the shim the fluid will envelope the coil. Alternatively the ferrofluid may be placed into the inner portion only of the voice coil and gap cavity after the voice coil assembly has been installed by injecting the fluid into the cavity between the coil inside diameter and the pole piece outside diameter again after magnetization of the unit. A higher viscosity mix of ferrofluid may be required in this case to achieve the same degree of damping of the moving system.

STRUCTURE OF THE SPEAKERS AND LOCATIONS OF THE AIR VENTS

Figure 4:
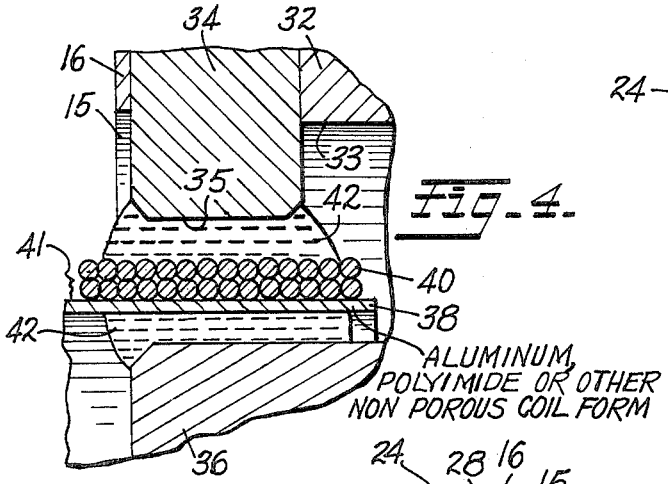
FIG. 4 is an enlarged fragmentary sectional view, illustrating the arrangement of the voice coil in the loudspeaker.

The automotive speaker 14 of FIGS. 1 and 2, is of the conventional type and the vent 31 is located in the rear plate 30 and pole 36 of the speaker. The vent permits the escape of air under the dynamic action of the voice coil. The speaker 14 is connected with leads 17 and 18 and mounted within basket 16. The openings in the basket serve an acoustic purpose which is well-known to improve the sound in the mid-range, e.g., from the low frequencies up to about 500 hertz. The diaphragm 24 is improved by the voice coil which is best shown in FIG. 4, the voice coil 40 being formed of windings and the air gap being filled with ferrofluid 42. The front plate 34 serves as one of the barrier to the ferrofluid 40 and the core pole 36 as shown in FIG. 4 serves as the other. The meniscus for the liquid ferrofluid 42 is slightly exaggerated as shown in FIG. 4 but represents the configuration observed in all of the other embodiments in approximately the same spacing and voice coil structure herewith. Compare FIG. 5 with FIG. 4.

The voice coil 38 is generally mounted on a nonpourous aluminum form so that leakage through the form does not occur. Wicking action can also be eliminated by a polyimide or similar non-porous coil form as noted by legend in FIG. 4. The magnet 32 is of the conventional type and the opening which is provided in the magnet represents an example of a vent which is convenient to provide in the magnet.

Figure 3:
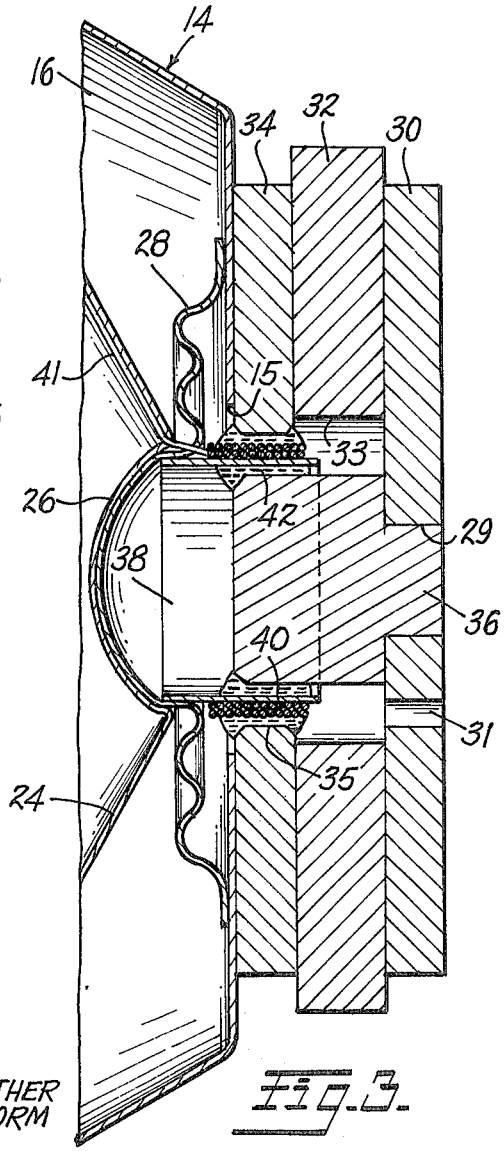
FIG. 3 is an enlarged fragmentary vertical sectional view, taken on the line 3—3 of FIG. 1.

The diaphragm connection is shown best in FIG. 3 and the dust cap 26 which protects the ferrofluid 42 against contamination is not a tight fitting relationship with the Bellows portion of the diaphragm. The clip 19 and jack 20 serve to permit the easy mounting and plugging of the automotive speaker 14 inside of the door of a vehicle. The connector 22 which is used at the ends of leads 17 and 18 is of the conventional flat type. The rear plate 30 magnet 32 and central opening in the magnet 33 are those which are found in the conventional air gap speaker of this type and are best viewed in the section shown in FIG. 3.

The behavior of the ferrofluid may be contrasted by various mixes and established that there is a remarkable change at the low frequency, a flattening of the curve at the fundamental and a repression of the harmonic of about 1500 cycles. In the absence of any ferrofluid, the curve shows a steep rise up to almost 100 decibels at the fundamental, a sharp drop in the range of 150 – 500 to show much poor performance, a rise between 500 and a thousand cycles in a critical range at human ear and a sharp drop at the fundamental. The addition of a 700 cp ferrofluid brings the output down and flattens the curve very substantially between 30 cycles and a thousand. The addition of 1000 cp fluid brings the output even lower and gives almost a flat response between 150 and 1,000 and a great repression of the fundamental. The addition of 6,000 cp fluid (2:1 mix) cuts the decibels even further and gives the performance that one could achieved in only a very high quality speaker.

Figure 9:
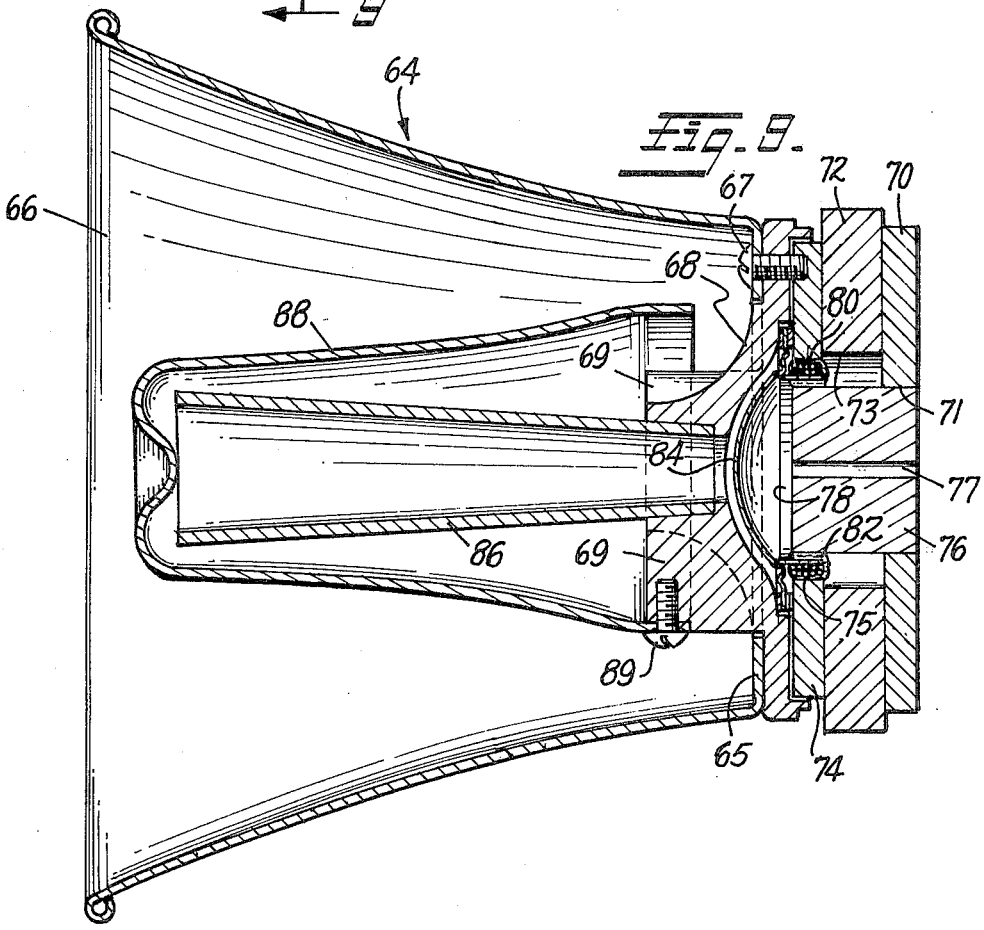
FIG. 9 is a vertical sectional view, taken on the line 9—9 of FIG. 8.

The vent locations are comparable in each of the embodiments, for example, vent 57 is provided under dust cap 46 in the embodiment shown in FIG. 7, vent 37 is shown in the core pole 36 of the embodiment shown in FIG. 5, and vent 77 is provided in the core pole 76 of the double horn configuration in FIG. 9. Also, vent 137 is provided in the core pole 136 of the embodiment of FIG. 10 double cone configuration. The double cone configuration represents a full range speaker which covers a wider figure range than the mid-range speaker of FIGS. 1 and 2.

As mentioned hereinabove, the constructions of the other embodiments of FIGS. 5, 7, 9 and 10 are along conventional lines and improved in much the same manner as the speaker of FIG. 1 but the venting is distinctive for the introduction of the ferrofluid.

This conventional construction in FIG. 5 comprises rear plate 50 having aperture 51 for the air column magnet 50, core pole 56 and mounting plate 54 with its fasteners. The vented pole piece 56 fits in aperture 51 of the rear plate 50 and defines one boundary of the ferrofluid 62 and the front plate defines the other boundary. The voice coil 58 is similar to that in FIGS. 1–5.

The horn speaker 64 of FIG. 8 is also of conventional construction, having depending flange 65 at the rear of the horn bell 66 and mounting screws 67 to attach the bell to the speaker 68.

The arms 69 of the speaker attach to the front plate 74. Magnet 72 having an annular opening 73 is mounted between front plate 74 and rear plate 70. The core pole 76 is mounted in the opening 71 of the rear plate. The central vent 77 in pole 76 vents the air column and the voice coil form 78 mounts coil 80 for conversion in ferrofluid 82. The diaphragm 84 is thus effectively vented. The horn tone arm 86 is conventionally mounted in reflector 88, the latter being fastened by screws 89 to the horn arms 66.

In FIG. 10, the reference numerals of the construction are identical in the last two digits with all of those in FIGS. 1–5 except that they are preceeded with 100 – eg., are in the 100 series and the auxiliary cone 143 having the added acoustical function is present, it being attached to diaphragm 124 at its center by means of adhesive 145.

Having thus disclosed the invention, I claim:

1. A method for increasing the damping of a moving coil loudspeaker having a magnet, an air gap between the coil and a mounting plate and of increasing electrical power dissipation without introducing hiss or spurious noise comprising:

introducing into said air gap an amount of non volatile ferromagnetic liquid having a viscosity of 600 to 10,000 centipoises containing from about 4 to about 20% of colloidal magnetic particles to fill said air gap and be confined by magnetic action therein;

and venting said speaker to permit escape of entrapped air and prevent hiss.

2. A method as claimed in claim 1 wherein said ferromagnetic fluid is made by mixing at least two ferromagnetic liquids, one of lower viscosity and the other of higher viscosity.

3. A method as claimed in claim 1 wherein said ferromagnetic liquid is an aliphatic polyester.

4. A method as claimed in claim 1 wherein said ferromagnetic liquid is a silicone.

5. A method as claimed in claim 1 wherein said ferromagnetic liquid is a fluorocarbon.

6. A method as claimed in claim 1 wherein said ferromagnetic liquid is a hydrocarbon.

7. A method as claimed in claim 1 wherein said venting step is effected by boring a hole in the magnetic pole piece of said speaker.

8. A method as claimed in claim 7 wherein the air gap is covered with a dust cap.

9. The product of the method of claim 1.

10. The product of the method of claim 8.

* * * * *

UNITED STATES PATENT OFFICE
CERTIFICATE OF CORRECTION

PATENT NO. : 4,017,694
DATED : April 12, 1977
INVENTOR(S) : John A. King

It is certified that error appears in the above-identified patent and that said Letters Patent are hereby corrected as shown below:

| | |
|---|---|
| Column 2, line 4 | "diaphram" should read -- diaphragm -- |
| Column 3, line 57 | "interferance" should read -- interference -- |
| Column 3, line 59 | "diaphram" should read -- diaphragm -- |
| Column 5, lines 9 through 18 | delete this paragraph as it is a repitition of the previous paragraph |
| Column 5, line 31 | "loudpspeaker" should read -- loudspeaker -- |
| Column 5, line 64 | "Quantitavely" should read -- Quantitatively -- |
| Column 6, line 20 | after f insert-- o -- |
| Column 6, line 42 | "contigous" should read -- contiguous -- |
| Column 6, line 44 | "spurios" should read -- spurious -- |
| Column 6, line 46 | "spaker" should read -- speaker -- |
| Column 7, line 46 | "simpliest" should read -- simplest -- |
| Column 7, line 47 | "date" should read -- data -- |
| Column 7, line 62 | "hysterisis" should read -- hysteresis -- |
| Column 8, line 43 | "pesonnel" should read -- personnel -- |

UNITED STATES PATENT OFFICE
CERTIFICATE OF CORRECTION

PATENT NO. : 4,017,694
DATED : April 12, 1977
INVENTOR(S) : John A. King

It is certified that error appears in the above-identified patent and that said Letters Patent are hereby corrected as shown below:

Column 8, line 62 "coalesing" should read -- coalescing --

Column 9, line 52 "nonpou-" should read -- nonpo- --

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*